US007228577B2

(12) United States Patent
Broderick

(10) Patent No.: US 7,228,577 B2
(45) Date of Patent: Jun. 12, 2007

(54) INFLATABLE BEACH ENCLOSURE

(76) Inventor: Michael T. Broderick, 221-B Edgewater Park, Bronx, NY (US) 10465

( * ) Notice: Subject to any disclaimer, the term of this patent is extended or adjusted under 35 U.S.C. 154(b) by 208 days.

(21) Appl. No.: 10/987,824

(22) Filed: Nov. 12, 2004

(65) Prior Publication Data

US 2006/0102219 A1 May 18, 2006

(51) Int. Cl.
*A47G 9/06* (2006.01)

(52) U.S. Cl. ..... 5/417; 5/656; 5/420; 5/731

(58) Field of Classification Search ..... 5/417–420, 5/425, 655, 656, 655.3, 731, 732, 945, 630, 5/632; 52/3, 4; 135/116
See application file for complete search history.

(56) References Cited

U.S. PATENT DOCUMENTS

| | | | | | |
|---|---|---|---|---|---|
| 1,624,797 | A * | 4/1927 | Morehouse | 5/417 |
| 4,003,098 | A | 1/1977 | Fink | |
| 4,137,584 | A * | 2/1979 | Sharber | 5/417 |
| 4,332,112 | A | 6/1982 | Hsu | |
| 4,574,412 | A * | 3/1986 | Smith | 5/632 |
| D288,613 | S | 3/1987 | James et al. | |
| 4,681,195 | A * | 7/1987 | Trahan et al. | 190/2 |
| 4,709,430 | A * | 12/1987 | Nicoll | 5/417 |
| 4,726,084 | A * | 2/1988 | Keserovich et al. | 5/417 |
| 4,833,813 | A | 5/1989 | McLemore, Jr. | |
| 4,999,863 | A | 3/1991 | Kane | |
| 4,999,866 | A * | 3/1991 | Lindsey | 5/417 |
| 5,101,823 | A * | 4/1992 | Smith | 607/81 |
| 5,206,964 | A * | 5/1993 | Wilson, Sr. | 5/417 |
| 5,299,331 | A * | 4/1994 | Badillo | 5/417 |
| 5,351,348 | A * | 10/1994 | Beger | 5/420 |
| 6,163,905 | A * | 12/2000 | Noldus-Nilsen | 5/655.3 |
| 6,318,287 | B1 | 11/2001 | Klimenko | |
| 6,393,639 | B1 * | 5/2002 | Ohsner | 5/425 |
| 6,463,605 | B2 * | 10/2002 | Swagger, Jr. | 5/420 |
| 6,543,068 | B1 | 4/2003 | Penninger | |
| D487,297 | S | 3/2004 | Tyler et al. | |
| 6,839,921 | B2 * | 1/2005 | Cloutier et al. | 5/417 |
| 6,901,615 | B1 * | 6/2005 | Lombardo et al. | 5/417 |

* cited by examiner

*Primary Examiner*—Michael Trettel
(74) *Attorney, Agent, or Firm*—David R. Treacy

(57) ABSTRACT

An inexpensive enclosure providing a protected space on a beach, lawn or the like. An inflatable tube forms a wall surrounding a space having an open end, so that a user is shielded from small kicked or thrown material or objects, running pets and the like. The tubular wall has flaps extending from its bottom surface, with pouches or separate tubes which a user fills at the site to hold the enclosure in place. The enclosure may have a floor, and may have attachment portions for removably connecting an extension unit having a floor which extends beyond the open end of the space between side portions of the wall.

20 Claims, 3 Drawing Sheets

INFLATABLE BEACH ENCLOSURE

BACKGROUND OF THE INVENTION

The invention relates to collapsible enclosures adapted for use by one or two people on a beach or other generally level surface, in particular such enclosures which can provide protection against sand or small objects kicked or thrown by others.

The desirability of providing some portable shelter-like protection for people resting or sun-bathing on a beach or lawn has long been recognized. U.S. Design Pat. Des. 288,613 shows a combined shelter and comfort unit formed by flat wall and floor panels stretched over frames. The panels appear to be fabric with transparent window portions, and contain sleeve portions through which rigid tubing frame parts are passed. In addition to substantial cost, structures like this have the disadvantage that the frame parts, while flat, have an overall length and width equal to the shelter's width and height. As a result, even if the fabric can be readily slipped off some tubing sections so that a plurality of flat sections are formed, in a disassembled condition the shelter is bulky unless the frames pull apart into a large number of straight and/or corner lengths. The latter arrangement requires a large bag to hold all the parts, and substantial time by one or two people to assemble or disassemble. If just one part becomes lost, the shelter cannot be erected.

Many kinds of inflatable boats, floats and beach toys or furniture have been designed and sold but none of these are suitable for a simple shelter which requires no long or rigid poles to define a useful shape.

BRIEF SUMMARY OF THE INVENTION

According to the invention, a beach enclosure is formed by an integral unit having an inflatable tube forming walls defining a protected space having a closed end and an open end, and having flaps arranged for holding the enclosure in place.

In a first embodiment of the enclosure the flaps extend exteriorly of the protected space and are formed as pouches which the user can fill with sand or small rocks.

In another embodiment the enclosure includes a floor section extending between and integral with the walls, thereby providing a sand-free space. The floor section may also be inflatable to provide greater comfort.

In a configuration for single person use, the walls define a rectangular enclosure having one end wall and two side walls longer than the end wall, and the inflatable tube is generally circular in cross section. In an alternative embodiment providing greater protection, at increased cost, each wall may be formed by two or more tubes generally parallel to each other, such that when inflated the height of the wall is at least approximately twice its thickness.

In a further embodiment, the basic enclosure includes attaching elements for an extension unit for extra-tall people. The extension unit may be flat and may have a transverse tube at its remote end which can be filled with water.

In yet another embodiment, at least one tube has at least one cup holder. The cup holder may be fastened to the tube by a hook-and-loop fastener such as Velcro, or may preferably be formed as a cylindrical or frusto-conical depression in the top surface of the tube.

In another embodiment of the enclosure the flaps are formed with stabilizing tubes of smaller cross-section than a wall tube, which the user can fill with liquid such as water.

These tubes may be disposed exteriorly of the protected space, and may be generally parallel and close to the tubular walls. The stabilizing tubes may also be arranged within the protected space.

When the stabilizing tubes are within the protected space, they may be arranged partially underneath the wall tubes so that the stabilizing tubes are out of the user's way; or such a tube may extend crosswise near the closed end, and thereby also serve as a pillow for a user's head.

DETAILED DESCRIPTION OF THE INVENTION

Figure 1:
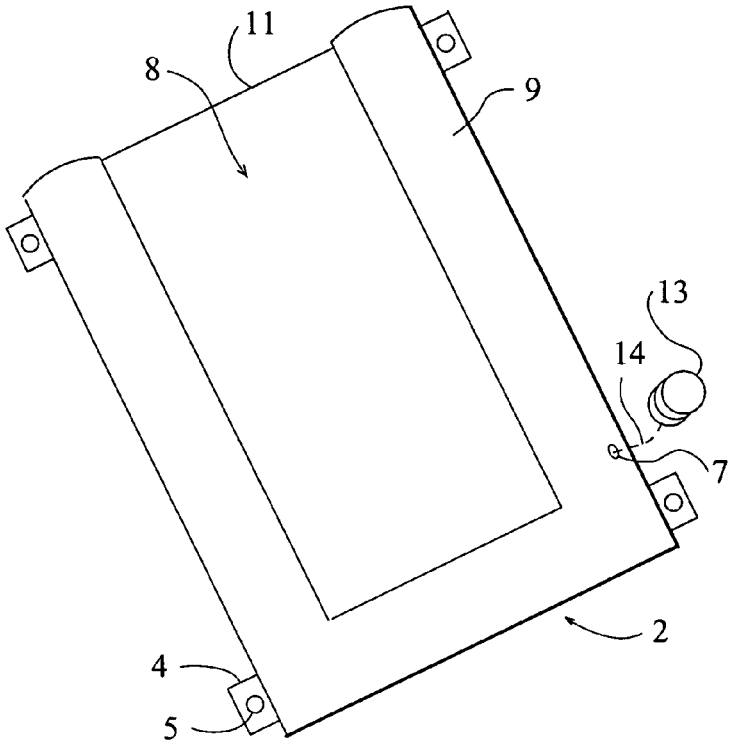
FIG. 1 is a perspective view of a simple shelter according to the invention.

As shown in FIG. 1, in a very simple form an inflatable enclosure according to the invention includes a cylindrical tube 2, round in cross section when inflated, and four flaps 4 each having a hole 5 for inserting a stake to hold the enclosure in place. An air valve 7 is provided for inflating and deflating the tube. The tube may be made from a sheet of thermoplastic material, with seams to define the desired shape, formed in any well-known way such as gluing or thermo-compression welding. The tabs 4 are desirably formed from the same material, but preferably are two layers thick, are attached by gluing or welding to the bottom surface of the side wall portions 9 of the tube 2, and extend exteriorly with respect to the space 8 between the side wall portions. Each hole 5 may be reinforced by a weld line around its edge, or may have a plastic or metal grommet permanently fastened in the hole. To provide a clean surface for a person to sit or recline, a floor 11 made of the same material as the tube may be glued or welded to the bottom surface of the tube 2, so as to be integral with the tube.

In FIG. 1, as in the other figures of the drawing, for simplicity the tube is shown as having square comers. For maximum strength and economy in manufacture the tube 2 will usually have seams and comers whose exact shape is dictated by the gluing, welding, or other technique used.

The embodiment of FIG. 1, especially if sold without the floor, requires a minimum of material and manufacturing operations. In a convenient size with a tube diameter of approximately one foot, and a space 3 feet wide by 6 feet long, the deflated enclosure can be folded into a very small size. If packaged with any widely available pump, such as a foot operated accordion pump 13 connectable to the air valve 7 by a flexible air line 14, the combination will be very compact and easy to carry. Preferably the air line 14 is permanently connected to the air pump 14, and plugs into the air valve 7 to inflate the tube 2. When inflation is complete, the air line may be removed and the valve 7 closed in any well known fashion, such as by insertion of a plug which is permanently attached to the valve by a short length of flexible plastic.

To be stable in place, and not be lifted or shifted by a breeze, the enclosure of FIG. 1 requires stakes. For use on sand, these may be simple plastic pins having a head to press down against the grommet. However, they are auxiliary items which are likely to be lost.

Figure 2:
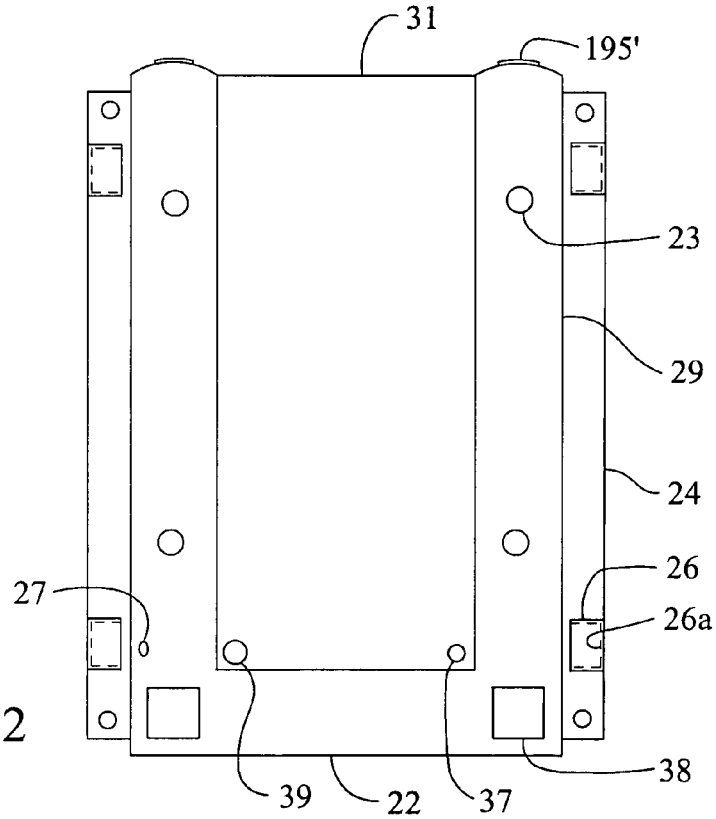
FIG. 2 is a plan view of a shelter according to the invention having additional comfort and convenience features.
Figure 3:
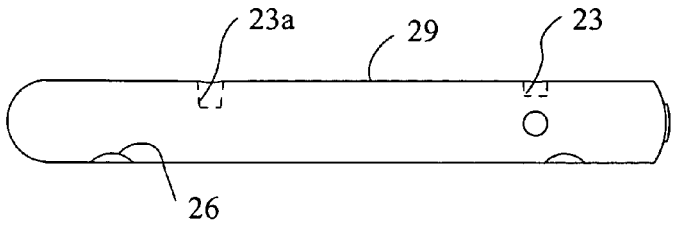
FIG. 3 is a side elevation of the shelter of FIG. 2.

The embodiment of FIGS. 2 and 3 provides additional comfort and convenience features at little increase in cost. A tube 22 is similar to the tube 2 but has holders 23 for beverages or other items molded into the top surface of the tube, preferably made of the same material as the tube 22 and spaced along the side walls 29. As shown by FIGS. 2 and 3, the tube 22 is elongated in a direction parallel to its top and bottom surfaces. A single long flap 24 extends outwardly from the bottom of each side wall 29. Each flap has a plurality of pouches 26 formed thereon, arranged so that a user can fill them with sand or small rocks, either before or after the enclosure has been inflated. Only two pouches 26 are shown on each flap in this figure, but a greater number may be desirable. In this embodiment the pouches are formed by holding pieces of thermoplastic material in an arched shape to define spaces under the pieces, and attaching each piece of material to the flap by a glue or weld line 26*a* running along the outside edge of the tab and then extending toward the adjacent tube so that the lower surface of the adjacent tube will reduce spillage of sand or rocks from the pouch while the shelter is being occupied.

The holders 23 can be identical, or one or two shown as holder 23*a* in FIG. 3 can be deep enough to hold a typical 12 ounce beverage container stably, while others can be shallow as 1½ or 2 inches deep.

At least one valve 27 is provided for inflating the tube 22.

To provide greater comfort when the beach or other surface is not fine sand, the shelter of FIG. 2 can have an inflatable floor 31 formed by upper and lower sheets of the same material as the tube 22, glued or welded to the bottom surface of the tube. One of these surfaces can be the same sheet of material as the flap 24. A pattern of weld or glue lines (not shown) can be formed between the upper and lower sheets so that the floor does not balloon up greatly in some areas when a person rests on another part of it. To minimize the need for strength, and resulting higher cost of the floor material, the pattern may tend to limit the inflated floor height to as little as ¼ inch. Because floor and tube pressure may be desirably different, a separate valve 37 is provided for inflating the space between the upper and lower sheets.

A utility pouch 38 for a user's personal articles, shown diagrammatically, is provided at each of the closed end comers. This may be permanently glued or welded in place, or may be removably attached by hook-and-loop patches, snaps, or other well known devices.

Figure 4:
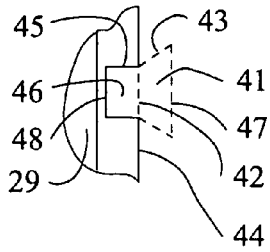
FIG. 4 is a partial plan view of an alternative pouch arrangement for the shelter of FIG. 2.

A through opening 39 can be provided in the floor panel for the pole of a beach umbrella or the like. Particularly if the hole is reinforced with a grommet, a user's weight on the floor of the shelter will stabilize an umbrella pushed into sand below the shelter, thereby reducing the annoying tendency of these umbrellas to tip from the desired angle FIG. 4 shows an alternative way to form pouches 46, by cutting the flap material so as to leave a series of regions 41 shown by dashed lines protruding from the main area of the flap 44. The region 41 can then be folded over along the dashed line 42 and its middle arched upward, for example so that edges 43 lie along the lines 45, and glued or welded along the lines 45. The resulting pouch 46 retains the arched shape because the edge 47 is longer than the line 48 as shown in the plan view. Like the pouches 26, each pouch 46 can easily be filled with sand or the like, or a rock or other locally available object of suitable size and weight can be placed in it.

Figure 5:
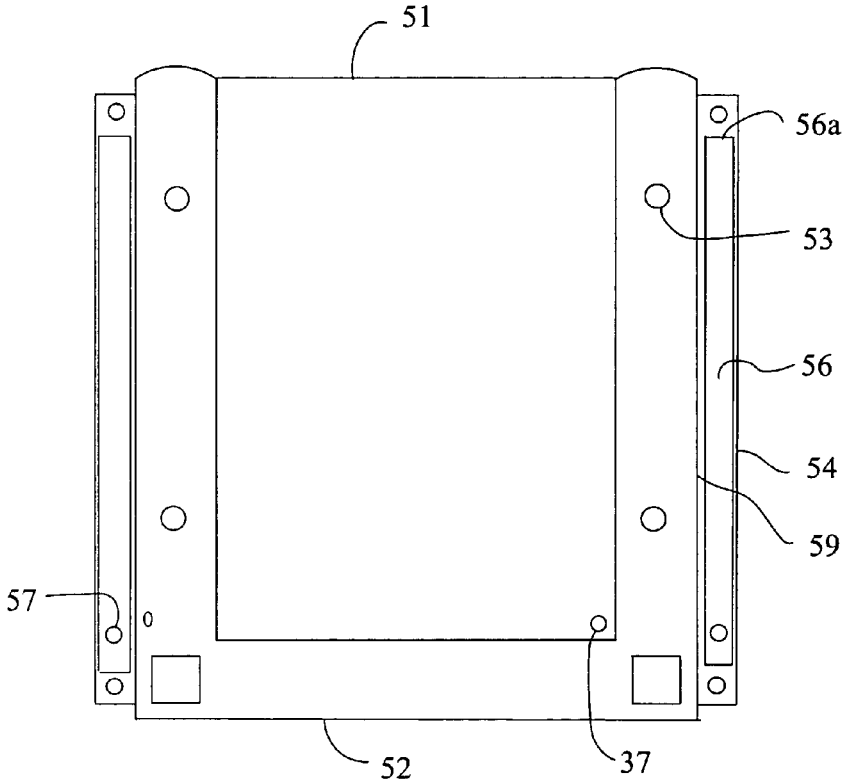
FIG. 5 is a plan view of a variation of the shelter of FIG. 2 having a water tube for holding the enclosure in place, and room for two people.

FIG. 5 shows a shelter generally like FIGS. 2 and 3, but with a different arrangement for holding the shelter in place, different arrangements for beverage holders or utility holders, and being shown with a wider protected space so that it can be occupied by two people. Tube 52 is similar to tube 22 except that the closed end may, for example, be 2 feet longer. Flaps 54 extend exteriorly from the bottom of side walls 59. Instead of pouches 26, each flap has a long tube 56 with a filling opening 57. The tube 56 can be filled with water, or any convenient liquid, by the user. Advantageously, if the floor 51 has upper and lower layers, these are continuous sheets of material which also form the upper and lower layers of the tubes 56, the tubes being defined by glue or welding lines 56*a*.

Instead of molded-in cup or utility holders 23, in the embodiment of FIG. 5 fastener patches 53 are provided, for temporary attachment of different size or style holders exteriorly of the tube 52.

Figure 6:
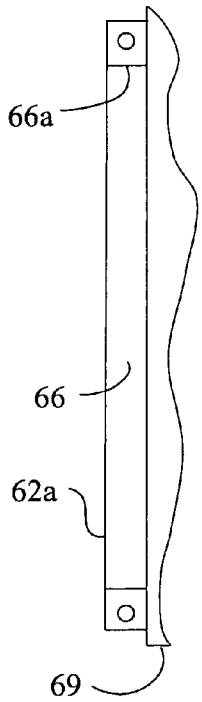
FIG. 6 is a partial plan view of an alternative water tube arrangement for the shelter of FIG. 5.

In an alternative construction of a shelter basically similar to that of FIG. 5, as shown in FIG. 6 the glue or welding attachment of the sheets to the bottom of the walls 69 can connect the sheets together, and define one long seam at the inner side of the tubes 66 so that only end seams 66*a* are additionally required. Further, like the embodiment of FIG. 4, one outside edge 62*a* can be defined by folding a long strip of material over to provide the upper and lower layers.

Figure 7:
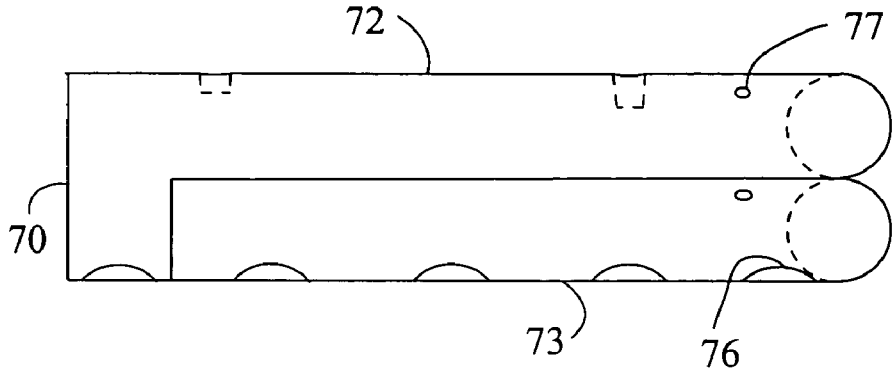
FIG. 7 is a side elevation of a shelter variation having a plurality of tubes to provide greater height.

The embodiment of FIG. 7 provides an enclosure whose height is at least double the wall thickness (tube diameter), through the use of an upper tube 72 and a lower tube 73, each having substantially the same generally circular cross section. To make the open end more rigid, the upper tube 72 may be made with a vertical portion 70 extending downward, with a glue or weld line connecting that portion to the end of the lower tube. The upper tube 72 and the lower tube 73 can be independent air chambers attached by a glue or weld line or a web of the same material as the tubes, and each having its own air valve 77. Alternatively, the air chambers formed by the two tubes can be connected by one or more openings aligned with each other where the two tubes touch, and likewise glued or welded. Because of the greater effect of wind on the higher walls, preferably this embodiment has larger stabilizing pouches 76 than the enclosure of FIG. 2.

While the double wall height of FIG. 7 will increase the shelter cost significantly, this extra protection will be especially desirable if the shelter is made wider, like that of FIG. 5, so that it can comfortably be occupied by two people.

Figure 8:
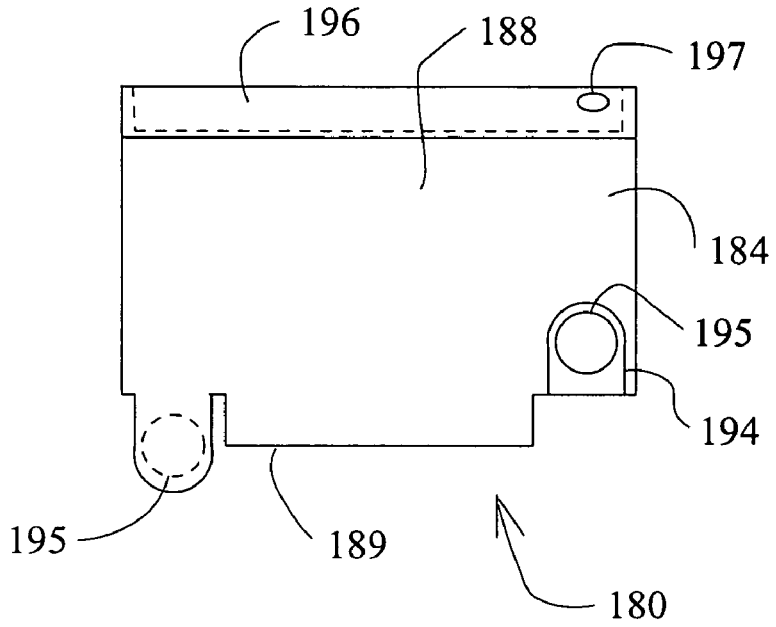
FIG. 8 is a plan view of an extension unit for the embodiment of FIG. 2.

People who are well above average height often find that, while ready-made clothing is available in sizes to fit almost everybody, recreational and other devices are often sold in one size only and are less than fully satisfactory for tall people. To enable an inexpensive shelter according to the invention to provide greater comfort, the extension unit of FIG. 8 provides a clean smooth surface for the feet and lower legs. Alternatively this unit allows the user to use some of the protected space remote from the open end for personal items such as spare clothing or a food basket which is therefore less apt to be dirtied or contaminated by sand or the like kicked up by others in the area. This is particularly effective because the basic enclosure is large enough to be noticed by others using the beach.

FIG. 8 shows an extension unit 180 having a central floor 188 which may be a single layer of the same material as used for the inflatable enclosure. Extending from the floor 188 are side portions 184, and an end flap 189 which will fit under the floor 31 of the embodiment of FIG. 2. For attaching the extension unit to the basic shelter each side portion 184 has a further portion 194, shown at the left in this view extending in the direction of the end flap, and an attachment patch 195 which as shown at the left in this figure is on the under side of the portion 194. The further portion 194 is shown at the right folded back over the flap 184 The patch 195 is preferably the hook portion of a hook-and-loop combination. For attachment of the extension unit 180 to the basic enclosure, each side wall portion 29 of the enclosure has a mating loop piece 195' shown in FIG. 2 on its end wall. To connect the extension unit, the portion 194 is bent upward so that the patch 195 is aligned with the piece 195' and they are pressed lightly together.

It will be clear that the choice of hook portion or loop portion may be interchanged. However, a user's clothing is less apt to catch on or cling to the loop portion if this is on the base unit, which is exposed when an extension unit is not attached.

To keep the extension unit lying flat, it has a long tube 196 extending substantially from the outer edge of one side portion 184 to the opposite outer edge. The tube may be filled with water through a valve 197. With this arrangement the tube 196 serves both to weight the end of the unit 180 down and stabilize it in position, and it also provides a desirable degree of stiffness to the end of the unit 180. If the user is at a beach or pool, the tube 196 can easily be filled with water before arranging the unit 180 with respect to the enclosure and connecting the attachment patches.

Figure 9:
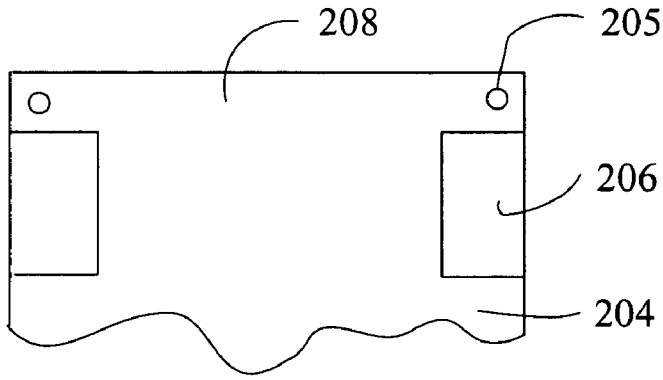
FIG. 9 is a partial plan view of a variation of the extension unit of FIG. 8.

Alternatively, as shown in FIG. 9 an extension unit 200 is like the unit 180 except for having holes 205 at two corners of a floor 208, and the side portions 204 may have pouches 206 similar to the pouches 26 or 46.

It will be clear to those of ordinary skill in the art that many variations of these embodiments can be provided, still utilizing the invention covered by the appended claims. For example, more than one opening can be provided in the floor panel so that flags or a small canopy can be erected where or when desired. Additional or different kinds of pouches, pockets, depressions or attachment points can be provided in convenient locations to allow placement of food containers, small clothing items, or safe storage of articles which are easily lost or damaged such as eyeglasses which one sometimes needs at a beach.

Rather than hook-and-loop patches, snap fittings or any inexpensive type of easy connecting/disconnecting fastener can be provided. This can be especially desirable for an extension unit.

Further, the claimed enclosure can be used advantageously on lawns or other places where some temporary shelter is desired, and the exact location of attachments, patches or pockets can be optimized for particular uses.

The parts for holding the enclosure in place can be provided at the interior sides of the tube instead of, or in addition to, the placement shown. If a flap is on the inside at the closed end, and is filled with water, this can serve not only to hold the shelter in place, but also be a pillow. Forming it as a flap rather than-an integral part of the floor can make filling it easier. Such a flap can alternatively be attached to the inner side of the tube 22. If it is near the bottom it can occupy what may otherwise be unusable space between the floor and the lower half of the tube. More or differently placed air valves can be provided, and the tube can be divided into a plurality of chambers. When the shelter has a double wall floor with a fill valve, many different designs of weld or partitioning lines can provide ornamental appearances as well as control the tendency of an inflated floor to bubble up around a user's body.

The rectangular shape shown is efficient for a person lying down. However, a round or rounded end may be easier to fabricate. The dimensions mentioned above are believed a desirable compromise between too little height, such that kicked, thrown or blown sand or the like would annoy a user, and a large size which is easily blown by gentle breezes. A smaller enclosure, on the other hand, may be useful to provide some protection for a small child.

The invention claimed is:

1. A collapsible enclosure comprising an inflatable structure formed as an integral one-piece unit having at least one inflatable tube arranged to form a wall surrounding a space having an open end, and having a flap arranged for holding the enclosure in place, and said wall having a top surface and at least one cup holder formed therein.

2. The enclosure according to claim 1, wherein said wall is formed by one said inflatable tube only, said one said inflatable tube being elongated in a direction parallel to said top surface.

3. The enclosure according to claim 1, wherein said wall defines a generally rectangular enclosure having one end wall portion defining a closed end, and two side wall portions, and wherein said wall has a bottom surface and said flap extends from said bottom surface exteriorly of the space.

4. The enclosure according to claim 3, wherein said wall is formed by one said inflatable tube only, said one said inflatable tube being elongated in a direction parallel to said top surface.

5. A collapsible enclosure comprising an inflatable structure formed as an integral one-piece unit having at least one inflatable tube arranged to form a wall surrounding a space having an open end, and having a flap including holding means, said holding means being arranged such that a user can fill said means with a heavy material for holding the enclosure in place.

6. The enclosure according to claim 5, wherein said wall has a bottom surface and said flap extends from said bottom surface exteriorly of the space.

7. The enclosure according to claim 6, wherein said holding means comprises a pouch.

8. The enclosure according to claim 6, wherein said flap has a hole for passing a pole therethrough.

9. The enclosure according to claim 6, wherein said wall is formed by one said inflatable tube only, said one said inflatable tube being elongated in a direction parallel to said bottom surface, and said wall has a top surface and at least one cup holder formed therein.

10. The enclosure according to claim 6, wherein said holding means comprises a pouch which a user can fill with sand or rocks.

11. The enclosure according to claim 10, characterized in that said pouch is formed by a portion of the flap which is folded over and fastened along two lines to the remainder of the flap.

12. The enclosure according to claim 5, wherein said holding means includes a tubular part which a user can fill with water.

13. The enclosure according to claim 12, characterized in that the integral one-piece unit comprises a floor section extending substantially across said space between portions of said wall, said wall defines an enclosure having one end wall portion and two side wall portions, each side wall portion having a wall end at said open end, said floor section is inflatable and is formed by upper and lower layers, and said tubular part is formed by extensions of said upper and lower layers.

14. The enclosure according to claim 12, characterized in that the integral one-piece unit comprises a floor section extending substantially across said space between portions of said wall, said wall defines an enclosure having one end wall portion and two side wall portions. each side wall portion having a wall end at said open end, said floor section is inflatable and is formed by upper and lower layers, and said floor section has a hole therethrough adapted for receiving a pole.

15. A collapsible enclosure comprising an inflatable structure formed as an integral one-piece unit having a plurality of tubes arranged to form a wall having a bottom surface and surrounding a space having an open end, each of said tubes being elongated in a direction parallel to said bottom surface and to each other, arranged such that when inflated the height of the wall is at least approximately twice the thickness of the wall, and the enclosure has a flap extending from said bottom surface arranged for holding the enclosure in place.

16. The enclosure according to claim 15, wherein said wall defines a generally rectangular enclosure having one end wall portion and two side wall portions, each side wall portion having a wall end at said open end, and each wall end comprising a vertical tube portion extending substantially the height of the wall.

17. A collapsible enclosure comprising an inflatable structure formed as an integral one-piece unit having at least one inflatable tube having a round cross-section arranged to form a wall surrounding a space having an open end, and having a flap arranged for holding the enclosure in place, wherein the integral one-piece unit comprises a floor section extending substantially across said space between portions of said wall, said wall defines an enclosure having one end wall portion and two side wall portions, each side wall portion having a wall end at said open end, and said enclosure comprises attachment portions at said wall ends arranged for removable connection of an extension unit.

18. The combination of an enclosure according to claim 17, and an extension unit having a floor portion and side flap portions, said side flap portions including means for removable connection to said attachment portions.

19. The enclosure of claim 17, wherein the said wall bas a top surface and at least one cup holder formed therein.

20. The combination of an enclosure according to claim 19, and an extension unit having a floor portion and side flap portions, said side flap portions including means for removable connection to said attachment portions.

* * * * *